US006076821A

United States Patent [19]

Embry et al.

[11] Patent Number: 6,076,821

[45] Date of Patent: Jun. 20, 2000

[54] METHOD AND APPARATUS FOR FEEDING SHEETS

[75] Inventors: Kerry Leland Embry, Lexington; Kevin Dean Schoedinger, Nicholasville; Phillip Byron Wright, Lexington, all of Ky.

[73] Assignee: Lexmark International, Inc., Lexington, Ky.

[21] Appl. No.: 09/152,639

[22] Filed: Sep. 14, 1998

[51] Int. Cl.[7] ..... B65H 5/00

[52] U.S. Cl. ..... 271/10.01; 271/10.02; 271/10.03; 271/110; 271/265.01

[58] Field of Search ..... 271/10.01, 10.02, 271/10.03, 10.09, 10.11, 110, 265.01

[56] References Cited

U.S. PATENT DOCUMENTS

| | | | |
|---|---|---|---|
| 3,734,491 | 5/1973 | Beery et al. | 271/51 |
| 4,318,540 | 3/1982 | Paananen et al. | 271/4 |
| 4,331,328 | 5/1982 | Fasig | 271/270 |
| 4,451,027 | 5/1984 | Alper | 271/10 |
| 4,645,194 | 2/1987 | Stobb | 271/203 |
| 4,691,912 | 9/1987 | Gillmann | 271/10 |
| 4,893,804 | 1/1990 | Sasage et al. | 271/3.1 |
| 4,986,526 | 1/1991 | Dastin | 271/227 |
| 5,056,771 | 10/1991 | Beck et al. | 271/114 |
| 5,121,914 | 6/1992 | Hargreaves | 271/110 |
| 5,121,915 | 6/1992 | Duncan et al. | 271/111 |
| 5,192,067 | 3/1993 | Saito | 271/10 |
| 5,193,797 | 3/1993 | Harada et al. | 271/115 |
| 5,295,677 | 3/1994 | Hutner | 271/110 |
| 5,326,184 | 7/1994 | Shibata | 400/624 |
| 5,415,387 | 5/1995 | Suzuki | 271/10 |
| 5,418,604 | 5/1995 | Nagakura et al. | 355/208 |
| 5,423,527 | 6/1995 | Tranquilla | 271/10 |
| 5,461,468 | 10/1995 | Dempsey et al. | 355/316 |
| 5,494,271 | 2/1996 | Wun et al. | 271/3.01 |
| 5,495,326 | 2/1996 | Mikida | 355/309 |
| 5,527,026 | 6/1996 | Padget et al. . | |
| 5,575,466 | 11/1996 | Tranquilla | 271/10.03 |
| 5,622,364 | 4/1997 | Dutton et al. . | |
| 5,626,334 | 5/1997 | Kondo et al. | 271/121 |

FOREIGN PATENT DOCUMENTS

| | | | |
|---|---|---|---|
| 2 312 667 | 11/1997 | United Kingdom | B65H 3/52 |

*Primary Examiner*—David H. Bollinger
*Attorney, Agent, or Firm*—John A. Brady

[57] ABSTRACT

Each sheet is picked from a stack of sheets with the time of it being picked being determined in accordance with the time of the prior pick. The sum of the times to advance a sheet its length and a desired gap between adjacent sheets is equal to a pick delay time and an expected feed time. If the measured feed time of the prior sheet exceeds a maximum feed time, the pick delay is the same as for the prior sheet. If the measured feed time of the prior sheet does not exceed the maximum feed time and the measured feed time of the prior sheet was less than the expected feed time, the pick delay is greater than the pick delay of the prior sheet. If the measured feed time of the prior sheet does not exceed the maximum feed time and the measured feed time of the prior sheet was not less than the expected feed time, the pick delay is less than the pick delay for the prior sheet.

12 Claims, 3 Drawing Sheets

METHOD AND APPARATUS FOR FEEDING SHEETS

FIELD OF THE INVENTION

This invention relates to a method and apparatus for feeding sheets from a stack of sheets and, more particularly, to a method and apparatus for controlling when each sheet is fed from a stack of sheets.

BACKGROUND OF THE INVENTION

When feeding sheets from a stack of sheets to a processing station such as a laser printer, for example, it is desired to feed the sheets as quickly as possible without a paper jam. Thus, a minimum gap must be maintained between adjacent sheets being fed from the stack of sheets.

Faster feeding of the sheets from a stack of sheets will increase the throughput of a printer. However, if faster throughput is obtained, for example, by increasing the speed of the motor driving the feed rollers, which pick the sheet from the stack of sheets, the power requirements of the printer will increase to increase the cost of the printer. Therefore, it is desired to maximize the throughput of a printer by feeding sheets from the stack of sheets at the fastest rate possible.

To obtain maximum throughput, a gap between the fed sheets should be as small as possible. When the sheets are fed from the stack of sheets by feed rollers mounted on a floating pick arm as shown and described in U.S. Pat. No. 5,527,026 to Padget et al, which is incorporated by reference herein, the time for the floating pick arm to settle increases as each sheet is removed from the stack of sheets. Accordingly, it is necessary that a minimum gap accommodate the settling characteristics of the floating pick arm without causing a paper jam when the floating pick arm feeds at the lowest point in the stack of sheets where the settling time is greatest.

SUMMARY OF THE INVENTION

The method and apparatus of the present invention satisfactorily solve the foregoing problem through selecting a gap sequence that can feed all of the sheets out of a tray even if the floating pick arm has not completely settled. A total time is selected for each sheet equal to the sum of the time that it takes to feed the sheet to a predetermined point and the time for the desired gap. Using this total time, each sheet is picked at a selected pick delay time with the pick delay time and an expected feed time equalling the time for the length of the sheet to pass the predetermined point and the time for the desired gap.

Except for the first sheet fed from any stack of sheets, the expected feed time of each fed sheet is referenced to the feed time of the prior sheet. The measured feed time for each sheet is also compared with a maximum feed time, which is the average feed time for the last sheet in the stack of sheets and a small additional amount. If the measured feed time for the sheet being fed exceeds the maximum feed time, there is no change in the pick delay time for the next sheet until the measured feed time of a fed sheet does not exceed the maximum feed time.

When the measured feed time of a sheet does not exceed the maximum feed time, the measured feed time of the sheet is utilized to control the pick delay time of the immediate next sheet. When the measured feed time of a sheet is less than its expected feed time, the measured feed time is employed directly to define the pick delay time. When the measured feed time of a sheet is not less than its expected feed time, then a limited amount is added to the expected feed time and that result is employed to define the pick delay time, which results in the next sheet being picked sooner.

The nominal amount of interpage gap is a machine design element. Similarly, the nominal pick delay amount depends on the length of paper preceding the sheet to be picked. Accordingly, these factors are determined during machine design and installed during manufacture of the machine. The length of paper during operation may be measured automatically from the setting of the paper tray or, alternately, input by the machine operator.

A feature of this invention is to provide a method and apparatus for feeding sheets from a stack of sheets with a relatively small gap between fed sheets.

Another feature of this invention is to provide a method and apparatus for feeding sheets from a stack of sheets in which the time for picking of each sheet is controlled by measuring the feed time of a sheet from pick to first encountering a sensor in the feed path without need to measure actual gaps or actual page lengths.

Other features of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
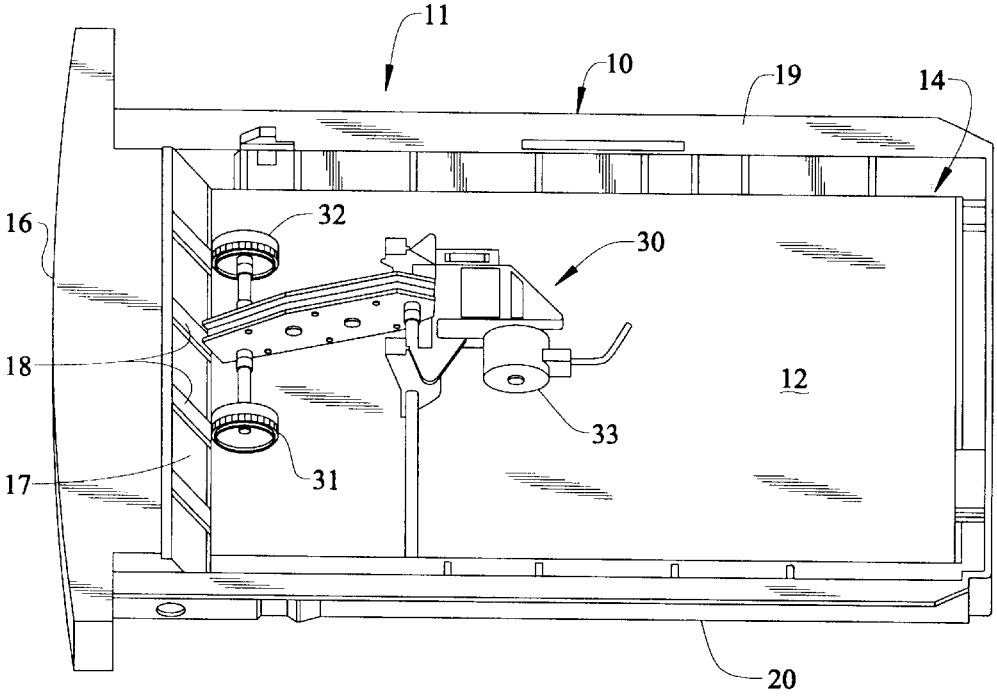
FIG. 1 is a top plan view of a sheet support tray of the present invention having a stack of sheets of media therein for advancement by an auto compensating pick mechanism.

Referring to the drawings and particularly FIG. 1, there is shown a tray 10 used in a printer 11. The tray 10 supports a plurality of sheets 12 of a media such as bond paper, for example, in a stack 14. The sheets 12 may be other media such as card stock, labels, or transparencies, for example.

The tray 10 has a bottom wall 15 (see FIG. 2) supporting the stack 14 of the sheets 12 therein. Adjacent its front end 16 (see FIG. 1), the tray 10 has an inclined wall 17 integral with the bottom wall 15 (see FIG. 2) of the tray 10.

The wall 17 (see FIG. 1) is inclined at an obtuse angle to the bottom wall 15 (see FIG. 2) of the tray 10 and to the adjacent end of the stack 14 of the sheets 12. The inclined or angled wall 17 (see FIG. 1) has ribs 18 against which each of the sheets 12 in the stack 14 is advanced into engagement. The sheet 12 is advanced from the ribs 18 towards a processing station of the printer 11 at which printing occurs.

The bottom wall 15 (see FIG. 2) extends between substantially parallel side walls 19 and 20 (see FIG. 1) of the tray 10. Each of the sheets 12 is advanced from the stack 14 by an auto compensating pick mechanism 30 of the type described in the aforesaid Padget et al patent.

The auto compensating pick mechanism 30 includes a pair of feed rollers 31 and 32, which are driven from a motor 33 through a gear train (not shown). The auto compensating pick mechanism 30 is more particularly shown and described in the published United Kingdom patent application of D. M. Gettelfinger et al, which is incorporated by reference herein, for "Sheet Separator", No. 2,312,667, published Nov. 5, 1997, and assigned to the same assignee as this application. The motor 33 is alternately turned off and on by a microprocessor 35 (see FIG. 2) as each of the sheets 12 is advanced from the top of the stack 14 of the sheets 12.

Figure 3:
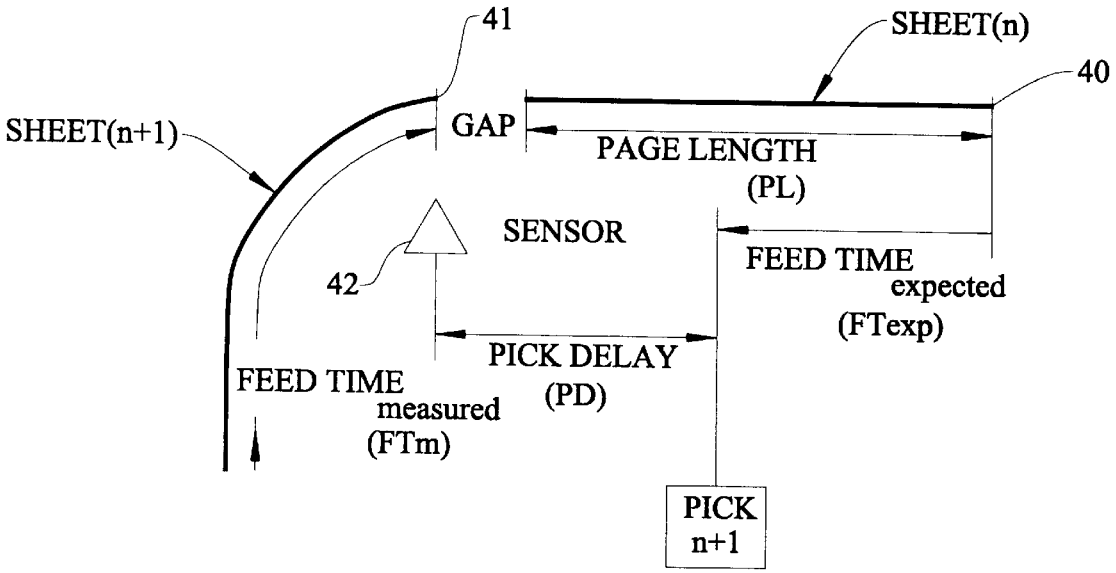
FIG. 3 is a timing diagram showing the relation between fed sheets.

FIG. 3 is intended to illustrate the system of operation of this invention. The first two of the sheets 12 advanced from the stack 14 are identified in FIG. 3 as sheet n followed by sheet n+1. The distance between leading edge 40 of the sheet n and leading edge 41 of the sheet n+1, nominally, is equal to page length (PL) and a desired gap (G) therebetween. PL represents the time for the length of each sheet to be advanced past a predetermined point and Gap (G) represents the time for the desired gap between two adjacent sheets to move past a predetermined point.

The time between the leading edge 40 of the sheet n and the leading edge 41 of the sheet n+1 is defined in accordance with this invention by a pick delay time (PD) plus an expected feed time ($FT_{exp}$). Thus, $$PD+FT_{exp}=PL+G \quad (1).$$

Solving equation (1) for PD results in $$PD=PL+G-FT_{exp} \quad (2).$$

Accordingly, $FT_{exp}$ is a subtraction, suggested in FIG. 3 by the leftward direction of the arrow labeled FEED TIME expected.

Except for the first sheet after power is turned on or the first sheet after a tray has been removed from its position and returned thereto, the expected feed time ($FT_{exp}$) for each sheet is determined with reference to the measured feed time of the prior sheet. The first sheet is picked as soon as possible.

Figure 2:
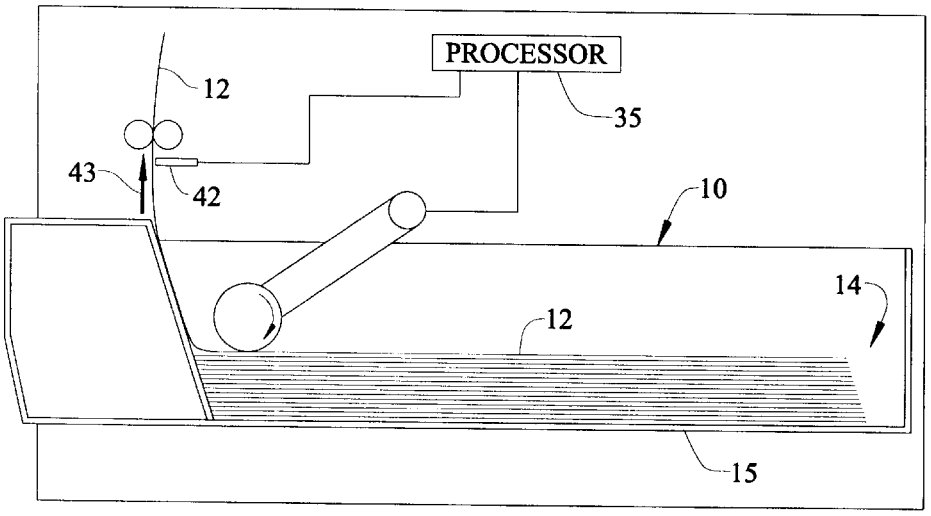
FIG. 2 is a schematic view showing the relation between the floating pick arm of the auto compensating pick mechanism, a stack of sheets of media in a tray, a sensor, and a microprocessor.

For example, the measured feed time ($FT_{m(n+1)}$) for the sheet n+1 in FIG. 3 is the time between when the microprocessor 35 (see FIG. 2) issues a pick signal to the motor 33 (see FIG. 1) of the auto compensating pick mechanism 30 until the leading edge 41 (see FIG. 3) of the sheet n+1 is sensed by a sensor 42. As shown in FIG. 2, the sensor 42 is located along a predetermined feed path 43 of each of the sheets 12 as it is advanced from the stack 14. The sensor 42 is preferably the first sensor passed by each of the sheets 12 as it is advanced from the stack 14.

When the first sheet n (see FIG. 3) is the first sheet 12 (see FIG. 2) to be advanced from another of the stacks 14 after power is turned on or after a tray has been removed from its position and returned thereto, length of the paper preferably is sensed automatically by settings of tray 10. The software in the microprocessor 35 provides a PL and gap values based on that length information to control the pick delay.

As first sheet n (see FIG. 3) is advanced, the sensor 42 senses when the first sheet n has the leading edge 40 pass the sensor 42. This feed time, which is from when the pick signal is issued to the motor 33 (see FIG. 1) until the leading edge 40 (see FIG. 3) of the first sheet n is sensed by the sensor 42, is measured as $FT_{m(n)}$.

A first sheet n (see FIG. 4) is picked immediately and the measured feed time $FT_{m(n)}$ is entered as $FT_{exp(n+1)}$. That entry, $FT_{exp(n+1)}$, is entered in DEFINE PD, action 45. DEFINE PD executes the foregoing formula: PD=PL+G−$FT_{exp}$ being the just determined $FT_{exp(n+1)}$. Action 45 causes a pick at the time dictated by that formula.

For a first sheet, a safety factor (not shown in FIG. 3) may be added in order to avoid anomalies relating to the insertion of a tray and its effects on feeding the first sheet. In the embodiment the safety factor is determined from preliminary tests and is zero for some cases, but in each case the safety factor is determined for the first sheet.

After the first sheet n has been fed, each of the following sheets 12 (see FIG. 2) has its feed time measured and used to determine the magnitude of new revised expected feed time. Thus, the sheet n+1 has the magnitude of its feed time $FT_{m(n+1)}$ measured as indicated in a block 47 (see FIG. 4).

As indicated in a block 48, the magnitude of $FT_{m(n+1)}$ is compared with the value of the maximum feed time $FT_{max}$. This value of the maximum feed time represents the feed time for a typical last sheet in the stack 14 (see FIG. 1) to reach sensor 42 reliably after being picked.

If the block 48 (see FIG. 4) determines that $FT_{m(n+1)}$ is greater than $FT_{max}$, then in action 49, $FT_{exp(n)}$ is entered as $FT_{exp(n+1)}$ meaning no change is made from the previous feed time expected. Action 49 enters $FT_{exp(n+1)}$ in DEFINE PD 45, and a pick signal is produced by an $FT_{exp(n+2)}$, which is the same as was $FT_{exp(n+1)}$ and therefore a smaller quantity than might have been entered. The smaller the quantity, the longer the delay.

Referring again to FIG. 4, if $FT_{m(n+1)}$ is not greater than $FT_{max}$, then a determination is made in a block 50 as to whether $FT_{m(n+1)}$ is less than $FT_{exp(n+1)}$. If $FT_{m(n+1)}$ is not less than $FT_{exp(n+1)}$, then that DEFINE PD 45 has a different value submitted for $FT_{exp(n+2)}$ as indicated in block 51. The new value for $FT_{exp(n+2)}$ is $FT_{exp(n+1)}$+x, where x is an additional predetermined increment factor, preferably in time constant increments of eleven milliseconds, with a maximum of two increments preferably used for each sheet. For convenience in implementation of the embodiment, when $FT_{m(n+1)}$ represents twenty-two milliseconds or more with respect to $FT_{exp(+1)}$, x is two increments, which is twenty-two milliseconds. Similarly, when $FT_{m(n+1)}$ represents less than twenty-two milliseconds with respect to $FT_{exp(n+1)}$, x is one increment, which is eleven milliseconds. (A clear alternative to one increment where system operation permits is to enter the actual value of $FT_{m(n+1)}$ into DEFINE PD 45.) It should be understood that the incremental size of x and the number of increments employed may be varied as desired for the particular software and system.

With $FT_{exp(n+2)}$ being increased in time as indicated in a block 51 and that quantity entered into DEFINE PD, the pick delay is decreased in time. Therefore the sheet n+2 will be picked sooner after the pick of sheet n+1 than was the sheet n+1 picked after the pick of sheet n.

Finally, if $FT_{m(n+1)}$ was not greater than $FT_{max}$ and if $FT_{m(n+1)}$ is less than $FT_{exp(n+1)}$, then $FT_{m(n+1)}$ is entered as $FT_{exp(n+2)}$ as indicated in a block 52 and that $FT_{exp(n+2)}$ is entered in to DEFINE PD 45, which defines a generally longer delay.

Accordingly, $FT_{exp(n+2)}$ may increase or decrease from $FT_{exp(n+1)}$ or stay the same.

Figure 4:
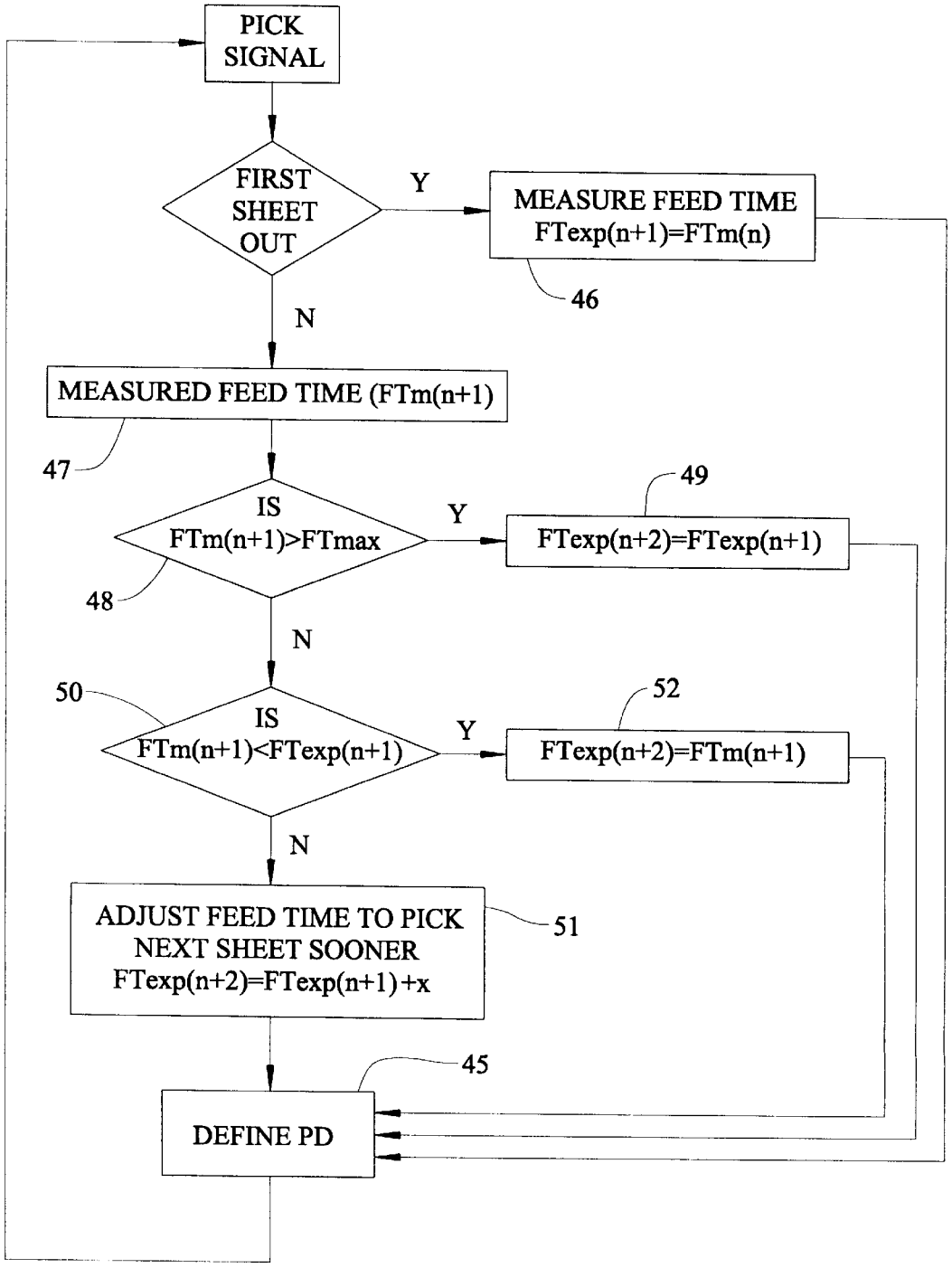
FIG. 4 is a flow chart of how the time of picking each sheet is determined.

It should be understood that the use of n, n+1, and n+2 in FIG. 4 with $FT_m$ and $FT_{exp}$ is to explain how the software functions. Thus, each of n+1 and n+2 will increase by one in FIG. 4 for each of the sheets 12 (see FIG. 1) being fed thereafter. After the first sheet, block 46 has no function, but, $FT_{exp}$ for the current sheet is set by blocks 49 and 52 in normal progress with n+1 becoming n+2 and n+2 becoming n+3, as is readily apparent.

The flow chart of FIG. 4 shows how software in the microprocessor 35 (see FIG. 2) is employed to possibly change the pick delay during advancement of each of the sheets 12 (see FIG. 1) from the stack 14. Therefore, the time interval between pick signals may stay the same, increase, or decrease.

When the printer 11 (see FIG. 1) has more trays than the tray 10 and there is a switch from picking the sheets 12 in the tray 10 to a second tray (not shown) since power for the printer 11 was turned on or the second tray was removed from its position and returned thereto, printer 11, being turned on, retains the pertinent information for each tray. Therefore, the first sheet picked from the second tray may not be the first sheet n of FIGS. 3 and 4.

If second sheet 12 is the second sheet picked from the second tray since power for the printer 11 was turned on or the second tray was removed from its position and returned thereto, the expected feed time for the second sheet 12 from the second tray, $FT_{exp(2nd\ sheet)}$, is equal to the expected feed time for the first sheet 12 picked from the second tray and supplied by the microprocessor 35 (see FIG. 2). In this situation, the second sheet 12 would be the sheet n+1 of FIG. 4, and the remainder of FIG. 4 would be applicable.

It should be understood that hardware circuits could be used to perform the functions rather than software, if desired.

While the feed time for the picked sheet 12 has been shown and described as being determined by the time from when the pick signal is issued until the sheet reaches a predetermined point, it should be understood that measuring the distance traversed by the picked sheet also may be utilized. For example, the main motor of the printer 10 (see FIG. 1) may have an encoder. Counting the total number of pulses from the encoder from when the pick signal is issued to pick the sheet 12 until the sensor 42 (see FIG. 3) senses the leading edge of the sheet 12 provides the distance traversed by the picked sheet.

Thus, instead of using times to obtain the various measurements, the encoder pulses are counted and compared with prior and stored counts in the same manner as previously described in the timing arrangement. Accordingly, each of the timing arrangement and the encoder pulse counting arrangement provides measurements.

An advantage of this invention is that it allows a desired throughput of a printer with minimum printer speed requirements. Another advantage of this invention is to reduce the possibility of paper jams while maintaining a desired gap between sheets fed from a stack.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A sheet feeding apparatus for feeding each sheet from a stack of sheets including:

picking means for picking a sheet from a stack of sheets for movement along a predetermined feed path;

advancing means for advancing each picked sheet along the predetermined feed path;

measuring means for measuring a feed period from when a pick signal is issued to said picking means until a picked sheet reaches a predetermined position along the predetermined feed path;

first determining means for initially determining whether the magnitude of the measured feed time is greater than a predetermined maximum feed time for feeding a sheet from the stack of sheets to the predetermined position;

first causing means for causing the pick signal to be sent to said picking means at the same time as defined by the prior picked sheet feed time if said first determining means determines that the feed time is greater than the predetermined maximum feed time;

second determining means for determining whether the magnitude of the measured feed time is less than an expected feed time for feeding a sheet from the stack of sheets to the predetermined position if the measured feed time is not greater than the predetermined maximum feed time;

second causing means for causing the pick signal to be earlier to said picking means than for the prior picked sheet if said second determining means determines that the measured feed time is not less than the expected feed time;

and third causing means for causing the pick signal to be issued later to said picking means than for the prior picked sheet if said second determining means determines that the feed time is less than the expected feed time.

2. The apparatus according to claim 1 in which said measuring means includes:

sensing means disposed along the predetermined feed path for sensing when the picked sheet reaches the predetermined position;

and timing means for timing the feed time between when a pick signal is issued to said picking means to activate said picking means and when said sensing means senses the picked sheet.

3. The apparatus according to claim 2 in which said second causing means causes the pick signal to be issued earlier to said picking means than for the prior pick signal by adjusting in increments of time.

4. The apparatus according to claim 1 in which said measuring means includes:

sensing means disposed along the predetermined feed path for sensing when a leading edge of the picked sheet reaches the predetermined position;

and timing means for timing the feed time between when a pick signal is issued to said picking means to activate said picking means and when said sensing means senses the leading edge of the picked sheet.

5. The apparatus according to claim 4 in which said second causing means causes the pick signal to be issued earlier to said picking means than for the prior pick signal by adjusting in increments of time.

6. The apparatus according to claim 1 in which said second causing means causes the pick signal to be issued earlier to said picking means than for the prior pick signal by adjusting in increments of time.

7. A method for controlling when each sheet in a stack of sheets is fed from the stack including:

picking a sheet from a stack of sheets in response to a pick signal for movement along a predetermined feed path;

measuring the feed time from when the pick signal is issued to cause picking of a sheet from a stack of sheets until the picked sheet reaches a predetermined position along the predetermined feed path;

determining whether the measured feed time exceeds a predetermined maximum feed time;

using the same time interval between the pick signal and the prior pick signal as the time interval between the prior pick signal and the preceding pick signal if the measured feed time exceeds the predetermined maximum feed time;

determining whether the measured feed time is less than an expected feed time if the measured feed time did not exceed the predetermined maximum feed time;

reducing the time interval between the pick signal and the prior pick signal if the measured feed time is not less than an expected feed time;

and increasing the time interval between the pick signal and the prior pick signal if the measured feed time did not exceed the predetermined maximum feed time and was less than the expected feed time.

8. The method according to claim 7 including measuring the feed time from when the pick signal is issued to cause picking of a sheet from a stack of sheets until the picked sheet reaches a predetermined position along the predetermined feed path by determining when a leading edge of the picked sheet reaches the predetermined position along the predetermined feed path.

9. The method according to claim 8 including reducing the time interval between the pick signal and the prior pick signal in increments of time.

10. The method according to claim 7 including reducing the time interval between the pick signal and the prior pick signal in increments of time.

11. A sheet feeding apparatus for feeding each sheet from a stack of sheets including:

picking means for picking a sheet from a stack of sheets for movement along a predetermined feed path;

advancing means for advancing each picked sheet along the predetermined feed path;

measuring means for measuring a feed measurement from when a pick signal is issued to said picking means until a picked sheet reaches a predetermined position along the predetermined feed path;

first determining means for initially determining whether the magnitude of the measured feed measurement is greater than a predetermined maximum feed measurement for feeding a sheet from the stack of sheets to the predetermined position;

first causing means for causing the pick signal to be sent to said picking means at the same measurement as for the prior picked sheet if said first determining means determines that the feed measurement is greater than the predetermined maximum feed measurement;

second determining means for determining whether the magnitude of the measured feed measurement is less than an expected feed measurement for feeding a sheet from the stack of sheets to the predetermined position if the measured feed measurement is not greater than the predetermined maximum feed measurement;

second causing means for causing the pick signal to be earlier to said picking means than for the prior picked sheet if said second determining means determines that the measured feed measurement is not less than the expected feed measurement;

and third causing means for causing the pick signal to be issued later to said picking means than for the prior picked sheet if said second determining means determines that the feed measurement is less than the expected feed measurement.

12. A method for controlling when each sheet in a stack of sheets is fed from the stack including:

picking a sheet from a stack of sheets in response to a pick signal for movement along a predetermined feed path;

measuring the feed measurement from when the pick signal is issued to cause picking of a sheet from a stack of sheets until the picked sheet reaches a predetermined position along the predetermined feed path;

determining whether the measured feed measurement exceeds a predetermined maximum feed measurement;

using the same measurement interval between the pick signal and the prior pick signal as the measurement interval between the prior pick signal and the preceding pick signal if the measured feed measurement exceeds the predetermined maximum feed measurement;

determining whether the measured feed measurement is less than an expected feed measurement if the measured feed measurement did not exceed the predetermined maximum feed measurement;

reducing the measurement interval between the pick signal and the prior pick signal if the measured feed measurement is not less than an expected feed measurement;

and increasing the measurement interval between the pick signal and the prior pick signal if the measured feed measurement did not exceed the predetermined maximum feed measurement and was less than the expected feed measurement.

* * * * *